US007942789B2

(12) United States Patent
Charniga, Jr. et al.

(10) Patent No.: US 7,942,789 B2
(45) Date of Patent: May 17, 2011

(54) EXERCISE DEVICE

(75) Inventors: Andrew Charniga, Jr., Livonia, MI (US); Genadi Hiskia, Netanya (IL)

(73) Assignee: Dynamic Fitness Equipment, LLC, Livonia, MI (US)

( * ) Notice: Subject to any disclaimer, the term of this patent is extended or adjusted under 35 U.S.C. 154(b) by 0 days.

(21) Appl. No.: 12/751,443

(22) Filed: Mar. 31, 2010

(65) Prior Publication Data

US 2011/0082012 A1 Apr. 7, 2011

Related U.S. Application Data

(62) Division of application No. 12/571,874, filed on Oct. 1, 2009, now Pat. No. 7,717,830.

(51) Int. Cl.
*A63B 22/00* (2006.01)

(52) U.S. Cl. ..... 482/54; 198/823; 198/841

(58) Field of Classification Search ..... 482/51–52, 482/54, 57; 198/826, 823, 841
See application file for complete search history.

(56) References Cited

U.S. PATENT DOCUMENTS

| | | | | |
|---|---|---|---|---|
| 4,024,949 | A * | 5/1977 | Kleysteuber et al. | 198/831 |
| 4,204,673 | A | 5/1980 | Speer, Sr. | |
| 4,793,470 | A * | 12/1988 | Andersson | 198/823 |
| 4,913,396 | A | 4/1990 | Dalebout et al. | |
| 4,958,832 | A * | 9/1990 | Kim | 482/61 |
| 5,007,528 | A * | 4/1991 | Hideharu | 198/823 |
| 5,336,146 | A | 8/1994 | Piaget et al. | |
| 5,467,866 | A * | 11/1995 | Swinderman | 198/841 |
| 5,607,376 | A | 3/1997 | Magid | |
| 5,626,539 | A | 5/1997 | Piaget et al. | |
| 6,269,943 | B1 * | 8/2001 | Mott | 198/823 |
| 6,348,025 | B1 * | 2/2002 | Schonenberger | 482/54 |
| 7,306,546 | B2 | 12/2007 | Lo | |
| 7,540,828 | B2 | 6/2009 | Watterson et al. | |
| 2009/0291807 | A1 * | 11/2009 | Moring et al. | 482/52 |

* cited by examiner

*Primary Examiner* — Steve R Crow
(74) *Attorney, Agent, or Firm* — Brinks Hofer Gilson & Lione

(57) ABSTRACT

An exercise device includes a support frame and a continuous running surface supported by the support frame. The support frame defines a horizontal plane having a longitudinal axis. The continuous running surface includes a movable belt and a plurality of sections mounted thereon and extending along a longitudinal axis of the belt. Each section includes an upper surface defining at least one inclined portion that is laterally inclined relative to the horizontal plane of the support frame. Adjacent upper surfaces of the plurality of sections define at least one laterally inclined track of the running surface.

20 Claims, 12 Drawing Sheets

EXERCISE DEVICE

CROSS-REFERENCE TO RELATED APPLICATIONS

This application is a divisional of U.S. patent application Ser. No. 12/571,874, filed Oct. 1, 2009 now U.S. Pat. No. 7,717,830, entitled "EXERCISE DEVICE," the entire contents of which are incorporated herein by reference.

FIELD OF THE INVENTION

The present invention relates generally to exercise devices, and more particularly to an exercise device having a laterally inclined surface.

BACKGROUND OF THE INVENTION

Conventional exercise treadmills provide a horizontal running surface which allows a user to perform running, walking, and other exercise routines in small and confined spaces. Some exercise treadmills utilize an inclining track which allows a user to simulate an outdoor exercise environment in which slopes and hills are encountered. Use of an incline provides a user with a varied exercise experience while also allowing changes in intensity and targeting of different muscle groups. The incline of conventional treadmill tracks is adjusted by raising or lowering the front or forward end of the track. There is a need for an exercise device having a track with a laterally inclined surface to provide the user with the ability to vary the stress placed on the user's ankles.

BRIEF SUMMARY OF THE INVENTION

According to one aspect of the present invention, there is provided an exercise device including a support frame defining a horizontal plane having a longitudinal axis. A running platform is supported by the support frame for supporting a user thereon. The running platform has a non-planar running surface that includes at least one portion that is laterally inclined relative to the horizontal plane of the support frame.

In a further aspect of the present invention, an exercise device includes a support frame defining a horizontal plane having a longitudinal axis. A continuous running surface is supported by the support frame for supporting a user thereon. The running surface includes a movable belt and a plurality of sections mounted thereon and extending along a longitudinal axis of the belt. Each section includes an upper surface defining at least one inclined portion that is laterally inclined relative to the horizontal plane of the support frame. Adjacent upper surfaces of the plurality of sections define at least one laterally inclined track of the running surface.

According to another aspect of the present invention, there is provided a shoe comprising an insole slanted about an axis extending between the toe and heel thereof. The insole may be slanted either inwardly or outwardly.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
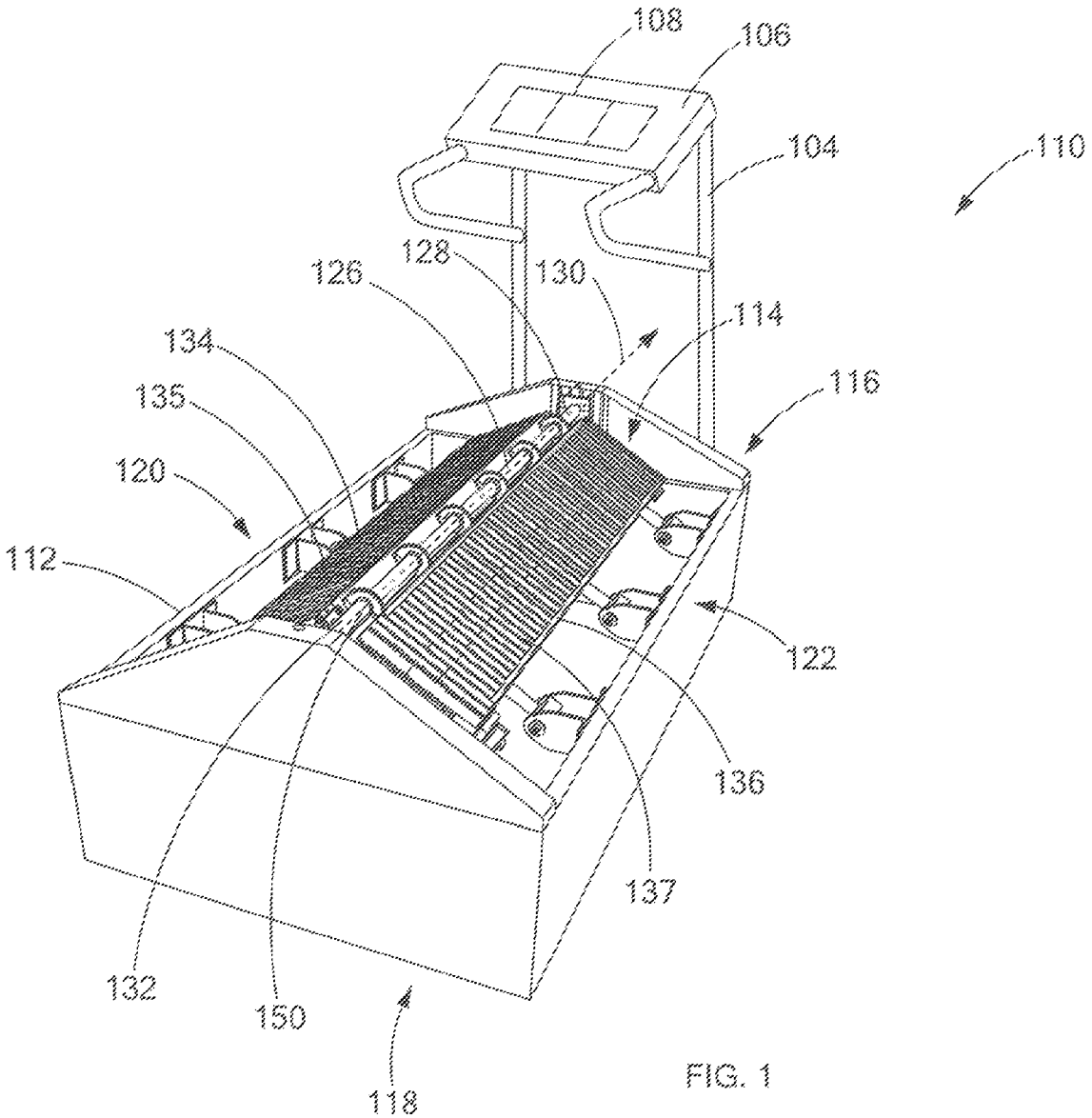
FIG. 1 is a perspective view of an exercise device in accordance with the teachings of the present invention, shown with the running platform in an inclined position.

Turning now to the figures, FIG. 1 depicts an exercise device 110 constructed in accordance with the teachings of the present invention. The exercise device 110 generally includes a support frame 112 and a running platform 114 supported by the support frame 112 for supporting a user in a running position thereon. The exercise device 110 includes a handrail 104 extending upwardly from the support frame 112, to which is mounted a control panel 106 having a user interface 108. It will be appreciated that the term "run" or "running" as recited herein is to be understood in its broadest sense, including, but not limited to, running, jogging, walking, or any other similar action.

Figure 2:
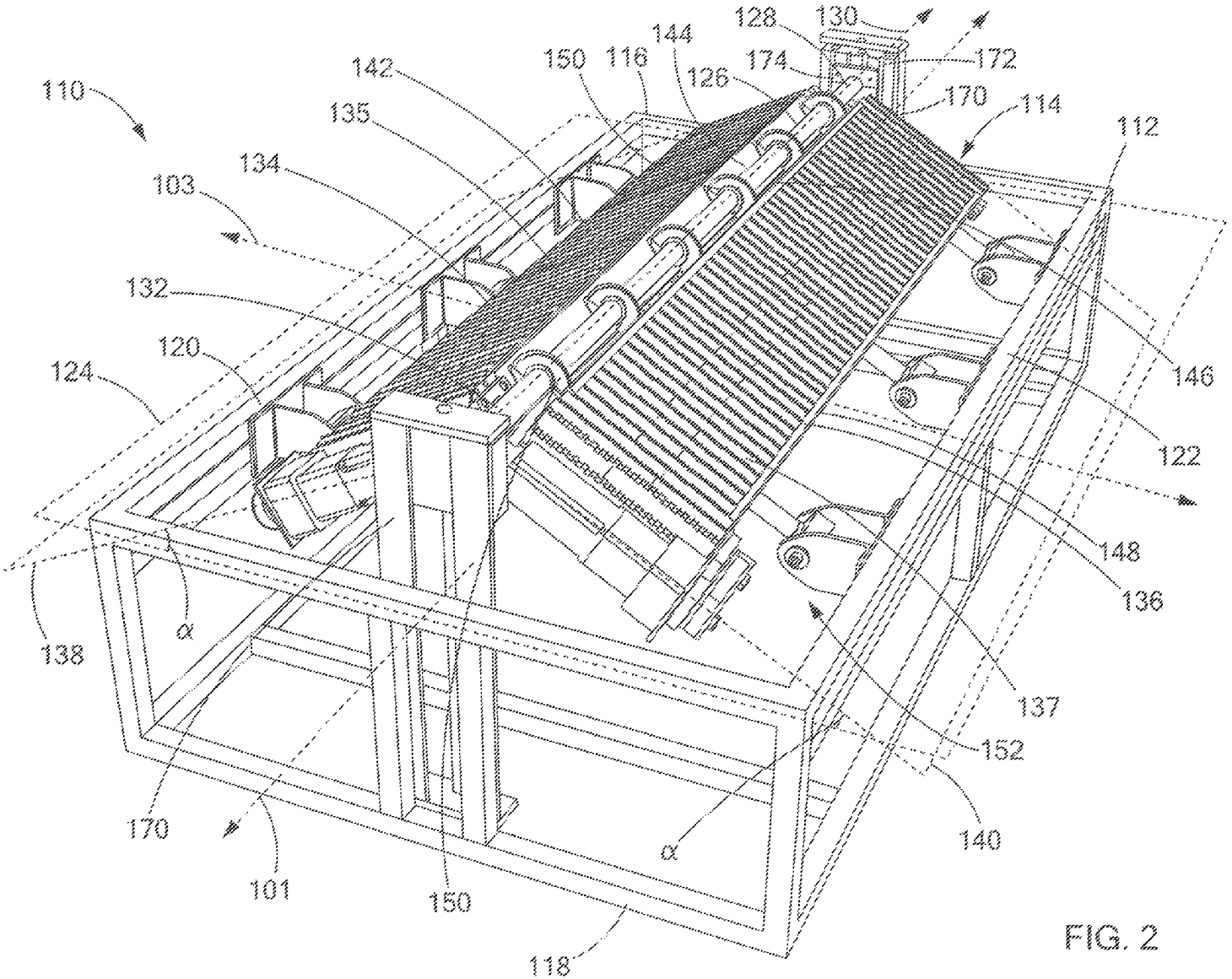
FIG. 2 is a perspective view of the exercise device of FIG. 1, depicting the support frame.
Figure 3:
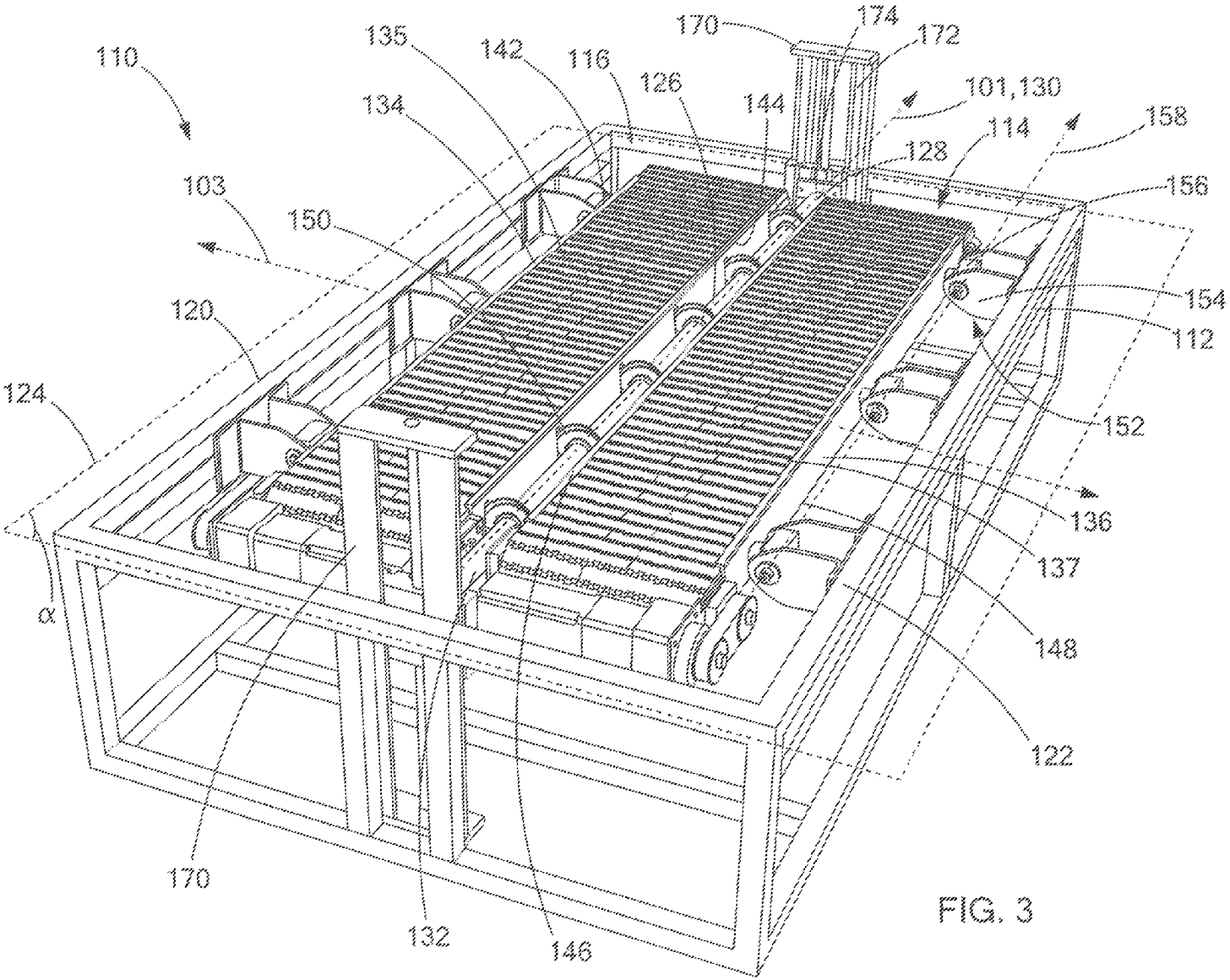
FIG. 3 is a perspective view of the exercise device of FIG. 2, shown with the running platform in a horizontal position.

As best illustrated in FIGS. 2-3, the support frame 112 includes a front portion 116, a rear portion 118, a left side 120, and a right side 122, and defines a horizontal plane 124, a longitudinal axis 101, and a lateral axis 103. Further illustrated in FIGS. 2-3, the running platform 114 includes a support member 126 extending longitudinally between the front 116 and the rear 118 of the support frame 112. As shown, the support member 126 extends from a front end portion 128 along a central axis 130 to a rear end portion 132. In this embodiment, the running platform 114 includes a left track 134 having a left running surface 135 and a right track 136 having a right running surface 137. The left and right tracks 134 and 136 are rotatably or pivotally connected to the support member 126 and the support frame 112 for lateral rotation. The left and right tracks are each operable between a horizontal position (FIG. 3) and an inclined position (FIG. 2), as described in further detail below.

The terms "lateral rotation" or "laterally rotated" as used herein are defined as rotating or pivoting the left track and/or the right track about a longitudinal axis as opposed to a lateral axis. For example, as further described in more detail with respect to FIGS. 1-4, the left and right tracks 134 and 136 are rotatable about pivot axes 158 and the central axis 130 of the support member 126 as the support member 126 to which the tracks 134, 136 are pivotally connected moves up and down. In another example, as further described in more detail with respect to FIGS. 6*a-b*, the left track 234 and/or the right track 236 is rotatable about the longitudinal axis 201 of the support frame 212. In yet another example, as further described in more detail with respect to FIGS. 7*a-c*, the left track 234 and/or the right track 236 is rotatable about a respective longitudinal axis defined by each of the tracks 234, 236. Thus, rather than the front or rear ends of the left and right tracks being pivotally supported like conventional treadmill devices, the sides of the left and right tracks and are pivotally supported, e.g., by the support frame and/or support members, to provide a laterally inclined surface. The terms "lateral rotation" and "laterally rotated" may be used interchangeably with "tilted sideways" or "laterally inclined." The term "laterally inclined" may be used to describe the incline of a laterally rotated track. Alternatively, the term "laterally inclined" may be used to describe an incline in the surface of a track, as illustrated in the examples shown in FIGS. 9*a-h*.

As illustrated in FIG. 2, the running platform 114 is in an inclined position. In this embodiment, the left and right tracks 134 and 136 are angled from the horizontal plane 124 of the support frame 112 to the same degree, i.e., by the same angle $\alpha$, but in opposite directions. In this embodiment, the left track 134 defines a left plane 138 that intersects the central axis 130 of the support member 126 and the right track 136 defines a right plane 140 that intersects the central axis 130 of the support member 126. As shown in FIG. 2, the left and right planes 138 and 140 intersect each other at an angle along the central axis 130 of the support member 126 in their inclined positions. In their inclined positions, the left and right planes 138 and 140 intersect the horizontal plane 124 of the support frame 112 at an angle $\alpha$, which can be varied as discussed further herein. Referring to FIG. 3, the left and right planes 138 and 140 of respective left and right tracks 134 and 136 substantially coincide with the horizontal plane 124 of the support frame 112 in the horizontal position. The left and right tracks 134 and 136 are laterally rotated, as further described herein, to move the running platform 114 between the horizontal position and an inclined position, the inclined position including various degrees of inclination.

As depicted in FIGS. 2-3, the left track 134 includes a left edge portion 142 rotatably connected to the left side 120 of the support frame 112 and a right edge portion 144 rotatably connected to the support member 126. The right track 136 includes a left edge portion 146 rotatably connected to the support member 126 and a right edge portion 148 rotatably connected to the right side 122 of the support frame 112. In this embodiment, the support member 126 is movably connected to the support frame 112 via the front and rear end portions 128 and 132 to move the left and right tracks 134 and 136 between the horizontal and inclined positions. In this embodiment, the support member 126 is movable up and down in a vertical direction relative to the horizontal plane 124 of the support frame 112 to vary the inclination of the left and right tracks 134 and 136, i.e., to vary the angle $\alpha$.

As shown in FIGS. 2-3, the right edge portion 144 of the left track 134 includes at least one pivot member 150, and the left edge portion 146 of the right track 136 includes at least one pivot member 150, for pivotally connecting the left and right tracks 134 and 136 to the support member 126. In this embodiment, there are six pivot members 150 shown connecting each of the left and right tracks 134 and 136 to the support member 126. However, there may be more or less pivot members 150 without falling beyond the scope of the present invention. The pivot members 150 may include any suitable pivot connection known in the art, including, but not limited to, the ring shaped pivot members 150 which receive the support member 126, as illustrated in FIGS. 2-3.

In this embodiment, each of the left and right sides 120 and 122 of the support frame 112 includes at least one hinge member 152 for hingedly connecting the left edge portion 142 of the left track 134 to the left side 120 of the support frame 112 and for hingedly connecting the right edge portion 148 of the right track 136 to the right side 122 of the support frame 112. In this embodiment, there are three hinge members 152 shown connecting each of the left and right tracks 134 and 136 to the support frame 112. However, there may be more or less hinge members 152 without falling beyond the scope of the present invention. The hinge members 152 may include any suitable mechanical hinge known in the art that would rotatably connect the running platform 114 to the support frame 112.

Figure 4:
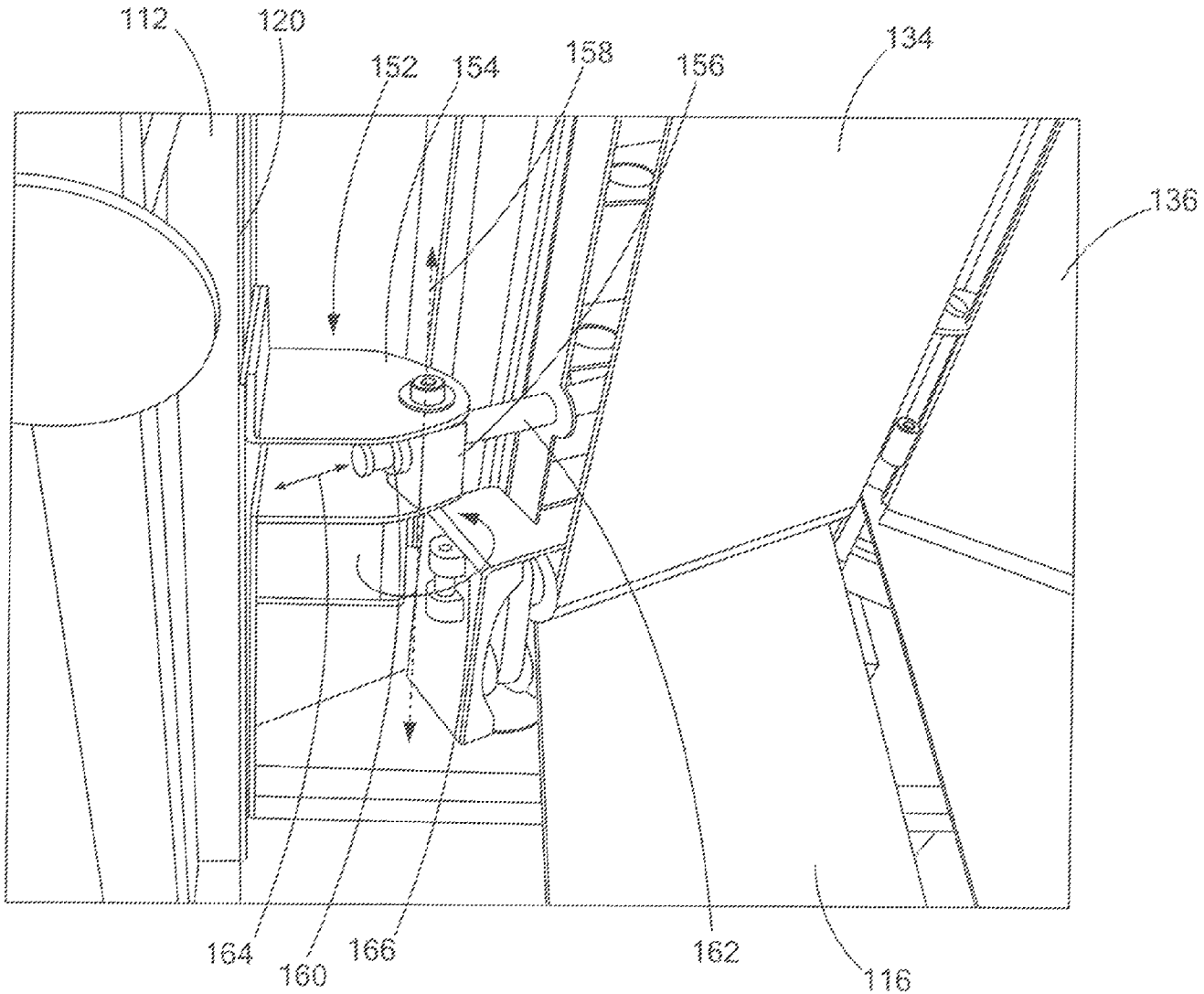
FIG. 4 is a close up view of a connection between a running platform and a support frame of an exercise device in accordance with the teachings of the present invention.

As best illustrated in FIG. 4, each hinge member 152 includes a mounting portion 154 secured to one of the left and right sides 120 and 122 of the support frame 112 by any suitable means in the art. The mounting portion 154 extends to a pivot receiving member 156 connected thereto by any suitable means in the art. In this embodiment the pivot receiving member 156 is received within openings of opposing sides of the mounting portion 154 and pivotally mounted therebetween. The pivot receiving member 156 defines a pivot axis 158 substantially parallel to the longitudinal axis 101 of the support frame 112 and the central axis 130 of the support member 126. In this embodiment, the pivot receiving member 156 includes an opening 160 formed therethrough. The opening 160 receives a pivot rod 162 attached to the left and right tracks 134 and 136. The pivot rod 162 is slidable within the opening 160 in a first direction, denoted by arrow 164. The pivot rod 162 is also rotatable about the pivot axis 158 in a second direction, denoted by arrow 166.

In this embodiment, the distance between the left edge portion 142 of the left track 134 and the left side 120 of the support frame 112 and the distance between the right edge portion 148 of the right track 136 and the right side 122 of the support frame 112 are adjustable to maintain a substantially constant distance between the right edge portion 144 of the left track 134 and the left edge portion 146 of the right track 136 as the support member 126 moves up and down relative to the horizontal plane 124 of the support frame 112 to vary the inclination of the left and right tracks 134 and 136 relative to the horizontal plane 124. Accordingly, the gap between the left and right tracks 134 and 136 is minimized, although it can be permitted to vary as the distance between the left and right sides 120 and 122 is.

Thus, in this embodiment, the connection between the pivot rods 162 of the left and right tracks 134 and 136 the hinge members 152 of the left and right sides 120 and 122 of the support frame 112 provide the exercise device 110 with the ability to maintain the distance (i.e., the gap) between the right edge portion 144 of the left track 134 and the left edge portion 146 of the right track 136. This is desirable to prevent a user's foot from becoming entrapped within a gap near the middle of the running platform 114.

Figure 5A:
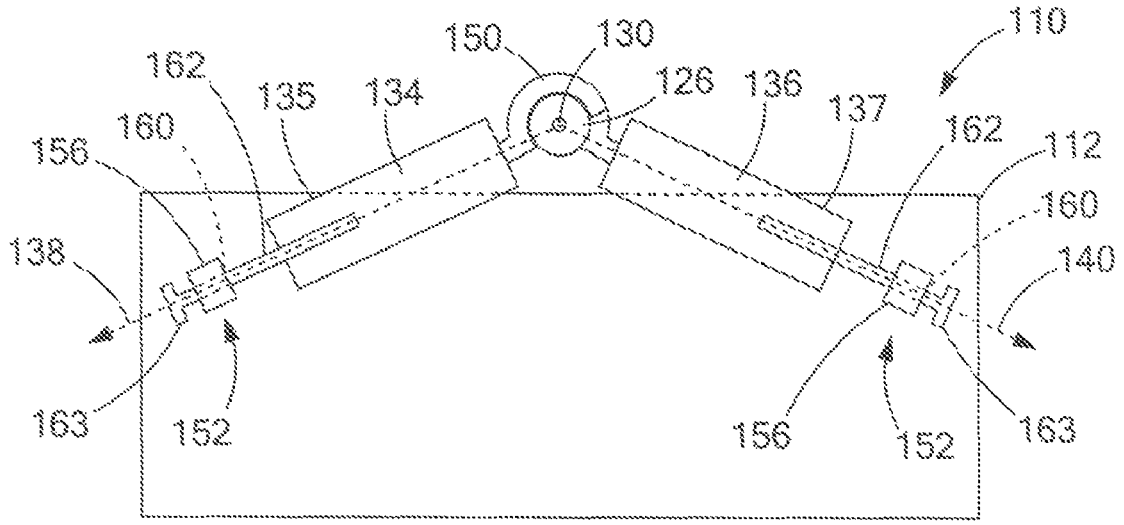
FIGS. 5*a-c* are schematic views of the exercise device of FIG. 1, depicting the running platform having various degrees of inclination.
Figure 5B:
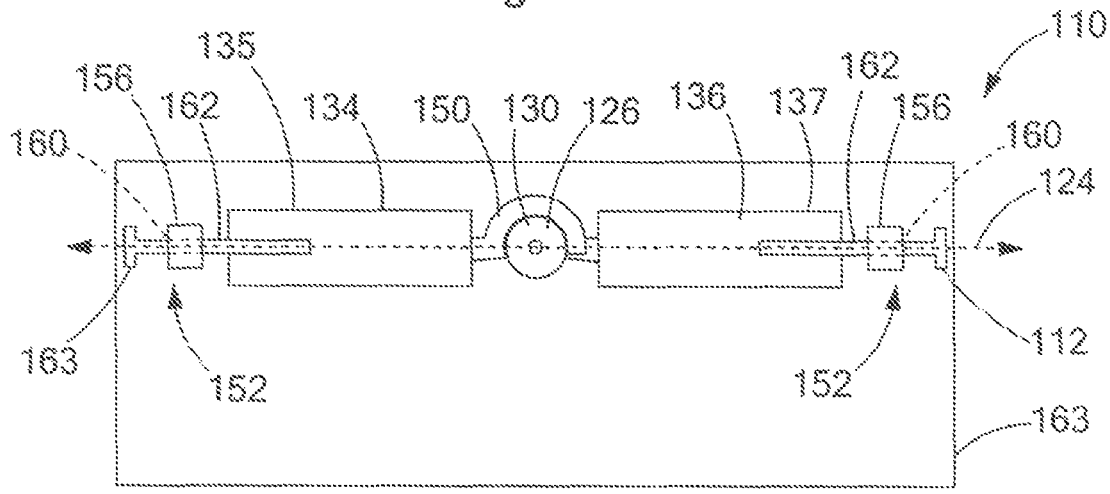
Figure 5C:
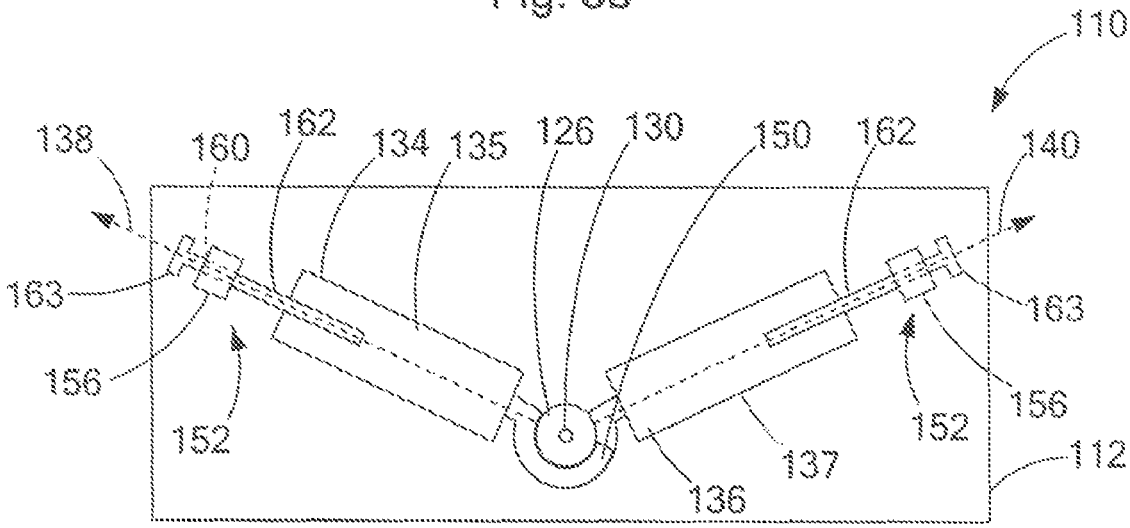

Referring to FIGS. 5*a-c*, the pivot rod 162 preferably has a predetermined length extending from the left and right tracks 134 and 136 to provide the freedom to move between the horizontal position (FIG. 5*b*) and an inclined position (see, e.g., FIGS. 5*a* and 5*c*). In the horizontal position, the distance between the left and right tracks 134 and 136 and the pivot receiving member 156 is the shortest and the length of the pivot rod 162 extending between the pivot receiving member 156 and the left or right side 120 or 122 of the support frame 112 is the longest. In the inclined position, the left and right tracks 134 and 136 move with the support member 126 away from the left and right sides 120 and 122 of the support frame 112 and thus, the distance between the left and right tracks 134 and 136 and the pivot receiving member 156 is larger than in the horizontal position and the length of the pivot rod 162 extending between the pivot receiving member 156 and the left or right side 120 or 122 of the support frame 112 is shorter than in the horizontal position. As illustrated, the pivot rod 162 terminates with a stop member 163 to prevent the pivot rod 162 from undesirably sliding all the way through the opening 160 of the pivot receiving member 156.

As shown in FIGS. 1-3, the support frame 112 includes a beam 170 preferably along the central region of each of the front and rear portions 116 and 118. The beams 170 include a rail 172 and a slide member 174 slidably positioned thereon. In this embodiment, the support member 126 is connected to the slide members 174 via the front and rear end portions 128 and 132 by any suitable means in the art. The user may control the movement of the support member 126 in the vertical direction along the rails 172 of the beams 170, and thus the incline of the running platform 114 relative to the horizontal axis 124 of the support frame 112, through the use of a control panel 106 and user interface 108 in communication with a motorbox (not shown).

In this embodiment, the left and right running surfaces 135 and 137 define continuous and endless running surfaces upon which a user runs during use of the exercise device 110. The left and right running surfaces 135 and 137 preferably include a plurality of individual tread links pivotally connected together and configured to continuously and endlessly move about the left and right tracks 134 and 136 in a direction parallel to the longitudinal axis 101 of the support frame 112. Alternatively, the left and right running surfaces 135 and 137 may be any typical treadmill belt known in the art configured to continuously and endlessly move about the left and right tracks 134 and 136 in a direction parallel to the longitudinal axis 101 of the support frame 112.

Figure 6A:
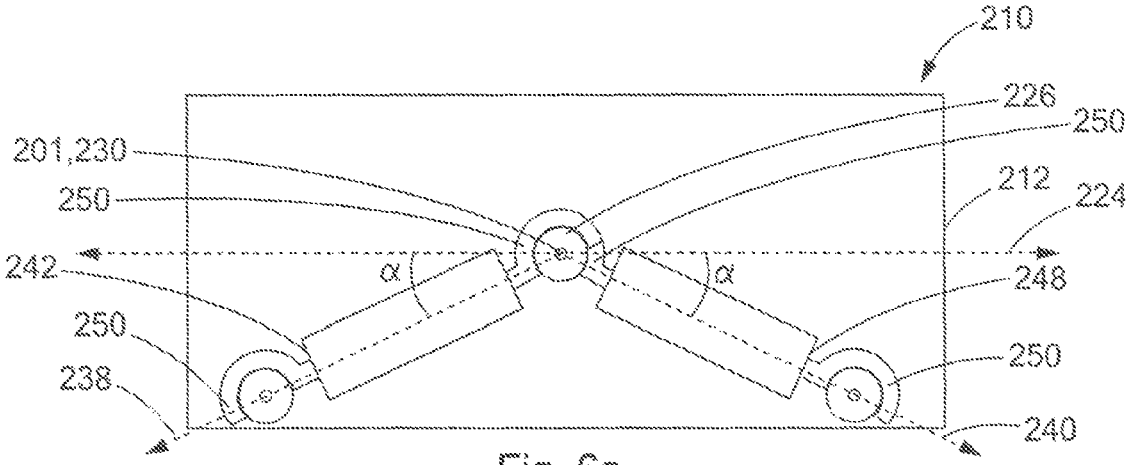
FIGS. 6*a-c* are schematic views of an exercise device in accordance with further teachings of the present invention, depicting the running platform having various degrees of inclination.
Figure 6B:
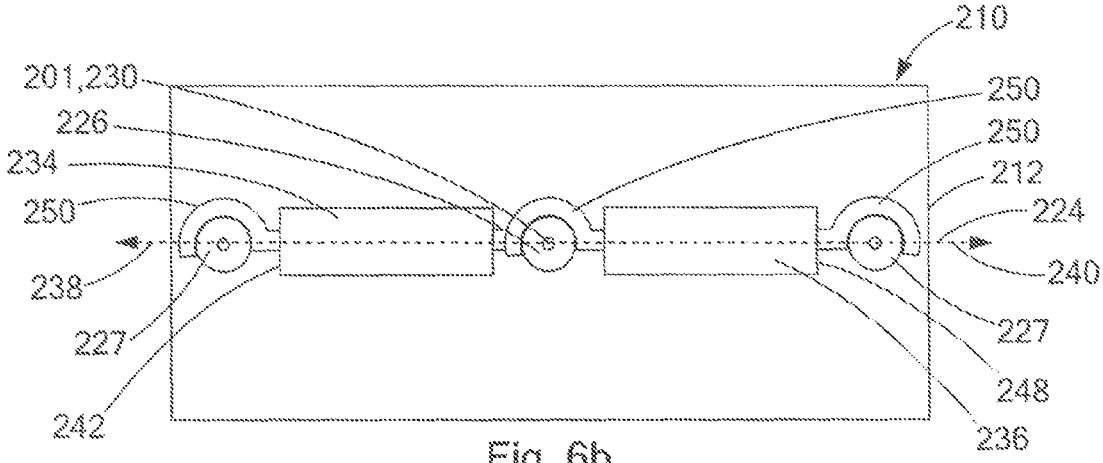
Figure 6C:
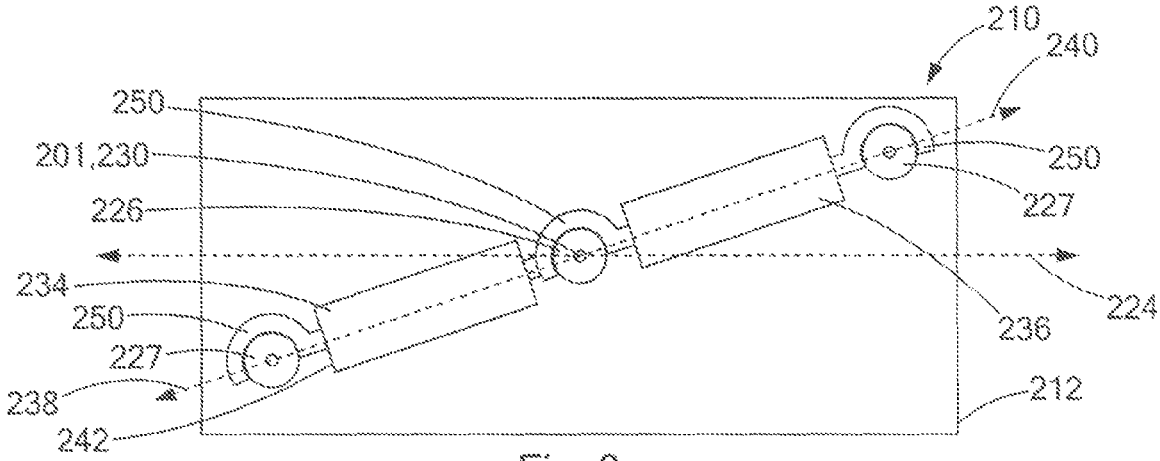

FIGS. 6*a-c* illustrate another embodiment of the invention having a description similar to that in FIGS. 1-3 and in which similar components are denoted by similar reference numerals increased by 100. Rather than a movable support member, the support member 226 of the exercise device 210 is fixedly connected to the support frame 212, i.e., stationary, while the sides of the left and right tracks 234 and 236, i.e., the left edge portion 242 of the left track 234 and the right edge portion 248 of the right track 236, are moved up or down relative to the horizontal plane 224 of the support frame 212 to vary the inclination, i.e., angle $\alpha$, of the left and right tracks 234 and 236. This also maintains the gap between the left and right tracks 234 and 236. Further, in this embodiment, the left and right tracks 234 and 236 may be laterally rotated independently of each other.

As shown in FIGS. 6*a-c*, the central axis 230 of the stationary support member 226 is coincident with the longitudinal axis 201 of the support frame 212 in the horizontal and inclined positions. In this embodiment, the left and right tracks 234 and 236 can be laterally rotated from the horizontal position (FIG. 6*b*) to an inclined position in which the left and right tracks 234 and 236 are angled from the horizontal plane 224 of the support frame 212 to the same degree (angle $\alpha$) but in opposite directions (e.g., FIG. 6*a*). In FIG. 6*a*, both the left and right tracks 234 and 236 are angled downward relative to the horizontal plane 234, the left track 234 being rotated from the horizontal position in a first direction about the longitudinal axis 201 (e.g., counterclockwise in FIG. 6*a*) and the right track 236 being rotated from the horizontal position in an opposite second direction about the longitudinal axis 201 (e.g., clockwise in FIG. 6*a*). In another example, the left and right tracks 234 and 236 can be laterally rotated from the horizontal position (FIG. 6*b*) to an inclined position in which the left and right tracks 234 and 236 are inclined in the same direction (e.g., FIG. 6*c*). In FIG. 6*c*, the left track 234 is angled downward relative to the horizontal plane 234 and the right track 236 is angled upward relative to the horizontal plane 234, both the left and right tracks 234 and 236 being rotated from the horizontal position in the same direction about the longitudinal axis 201 (e.g., counterclockwise in FIG. 6*c*).

In this embodiment, the left and right tracks 234 and 236 may be moved up and down by any suitable means known in the art. For example, each of the left and right tracks 234 and 236 may be pivotally connected via pivot members 250 to a second support member 227 that is movably connected to the support frame 212 by any suitable means in the art.

Figure 7A:
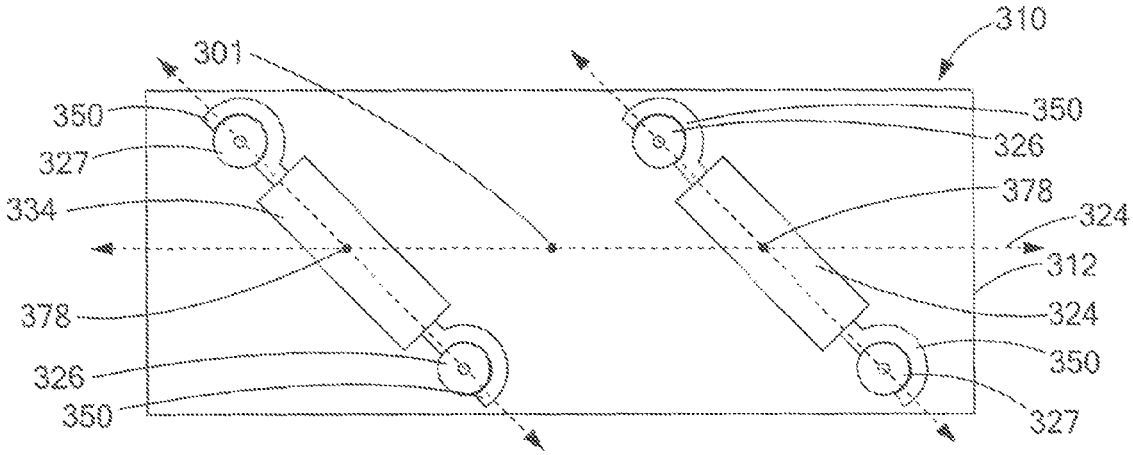
FIGS. 7*a-c* are schematic views of an exercise device in accordance with further teachings of the present invention, depicting the running platform having various degrees of inclination.
Figure 7B:
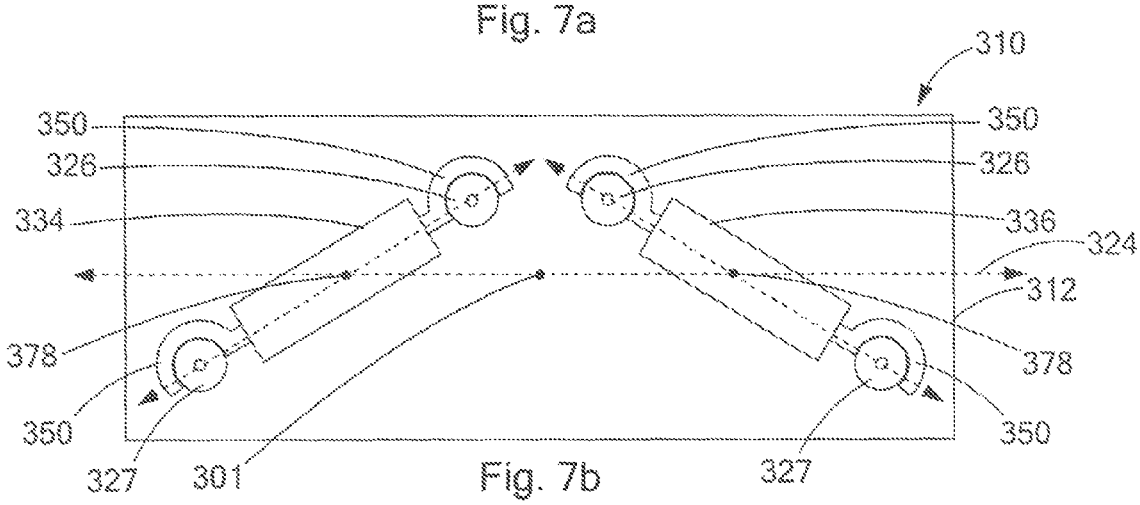
Figure 7C:
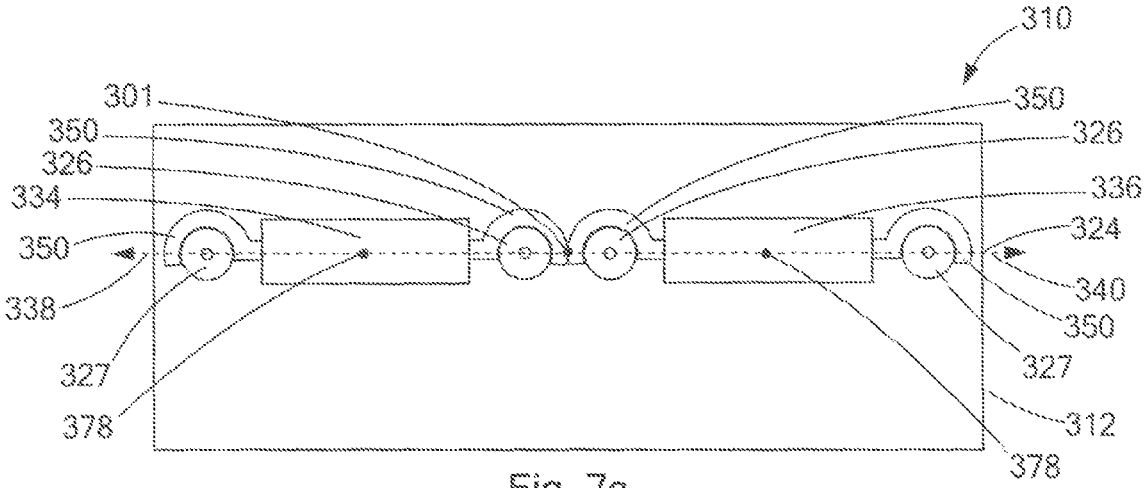

FIGS. 7*a-c* illustrate another embodiment of the invention having a description similar to that in FIGS. 1-3 and in which similar components are denoted by similar reference numerals increased by 200. In this embodiment, the left and right tracks 334 and 336 of the exercise device 310 are not rotatably connected to the same support member. Rather, each of the left and right tracks 334 and 336 is rotatably connected to its own support member 326. This provides for independent lateral rotation of the left and right tracks 334 and 336 relative to the horizontal plane 324 of the support frame 312. In this embodiment, the left and right tracks 334 and 336 each define a longitudinal axis 378 and each are laterally rotatable about this longitudinal axis 378. In this embodiment, the support members 326 are movably connected to the support frame 312 by any suitable means in the art. For example, the support members 326 may be movably connected to the support frame 312 in the same manner as the support member 126 is movably connected to the support frame 112 in FIGS. 1-3.

In this embodiment, the left and right tracks 334 and 336 may be rotatably connected to the support frame 312 by any suitable means in the art. For example, the left and right tracks 334 and 336 may be rotatably connected to the support frame 312 in the same manner as the left and right tracks 134 and 136 are rotatably connected to the support frame 112 in FIGS. 1-3. Alternatively, as illustrated in FIGS. 7*a-c*, the left and right tracks 334 and 336 may be pivotally connected via pivot members 350 to a second support member 327 that is movably connected to the support frame 312 by any suitable means in the art.

Figure 8A:
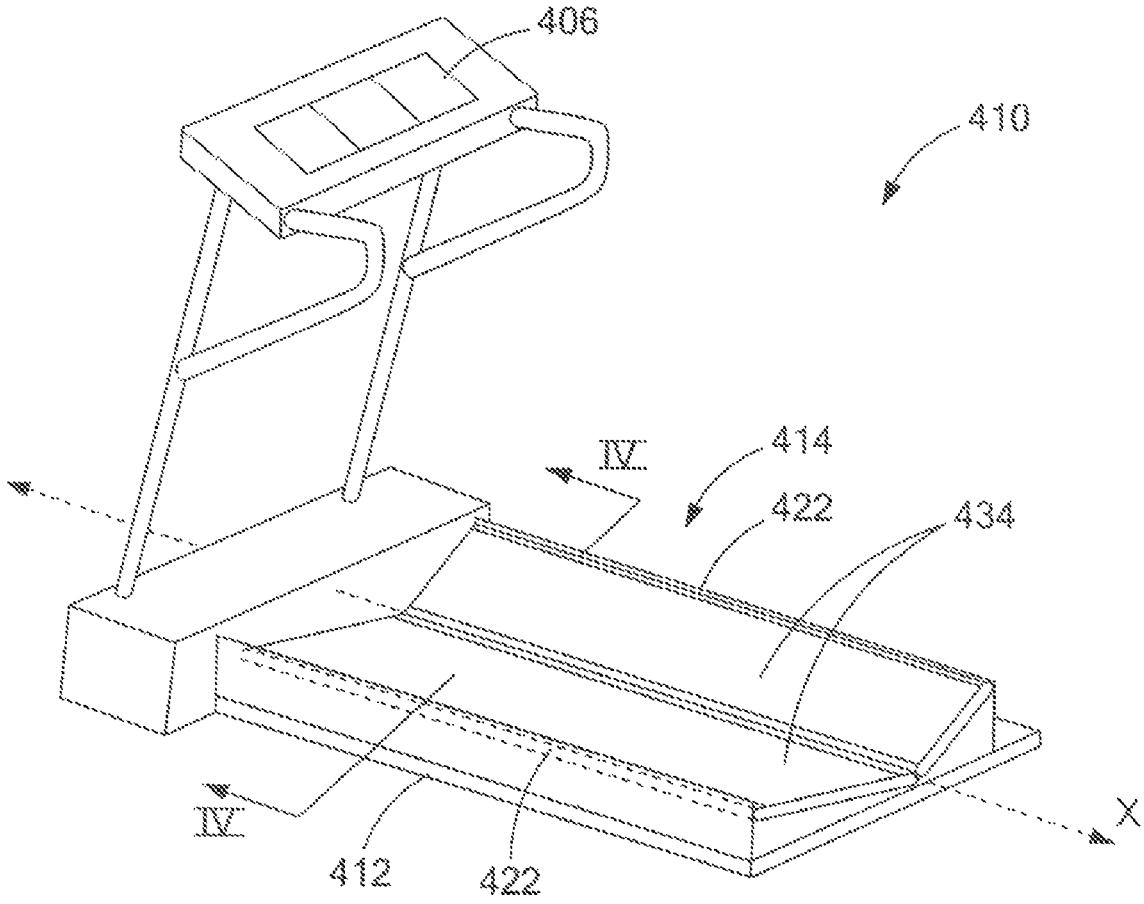
FIG. 8*a* is a perspective view of an exercise device in accordance with further teachings of the present invention.
Figure 8B:
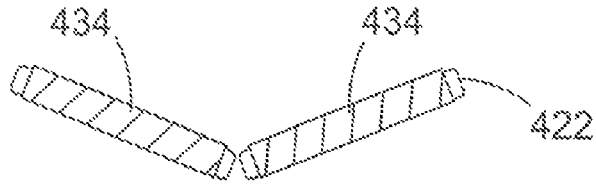
FIG. 8*b* is a cross-sectional view taken along line IV-IV in FIG. 8*a*, with only platforms and associated belts thereof illustrated.
Figure 8C:
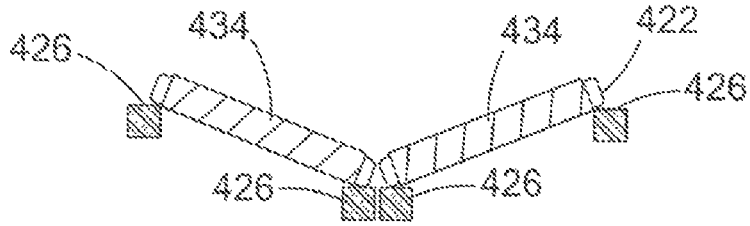
FIG. 8*c* is a cross-sectional view taken along line IV-IV in FIG. 8*a*, depicting a pivoting mechanism.

Further examples of the present invention are disclosed in Provisional Application Ser. No. 61/136,392, entitled Exercise Device, filed Sep. 2, 2008, incorporated by reference herein in its entirety. Referring to FIGS. 8*a-c*, the exercise device 410 includes a support frame 412 and a running platform 414 supported by the support frame 412. The running platform 414 includes an endless running surface 422 which may comprise two or more belts 434, each of which extends in the direction of the longitudinal axis X, and each of which is independently pivotable about an axis which is parallel to the longitudinal axis X. As such, each belt 434 may be mounted on the platform 414 which comprises a pair of rollers (not illustrated) to drive the motion of its associated belt 434. The platform 414 is associated with a pivoting mechanism 426, illustrated in FIG. 8*c*, which is adapted to pivot its associated platform, e.g., when it receives an appropriate command from the control panel 406. The pivoting mechanism 426 may be any suitable pivoting mechanism known in the art to provide lateral rotational movement to the platform 414, such as support members and pivot and hinge members described with respect to FIGS. 1-3. The two belts 434 may also be configured to move toward/away from one another in a direction transverse to the direction of movement, which permits providing a range of stance widths, e.g., for different users.

It will be appreciated that by providing two belts 434 which are independently pivotable, the need for providing three or more track portions is obviated, since the user can adjust the sense and/or degree to which each one is angled. However, a treadmill having three or more belts 434 may be provided without deviating from the spirit and scope of the present invention.

Figure 9A:
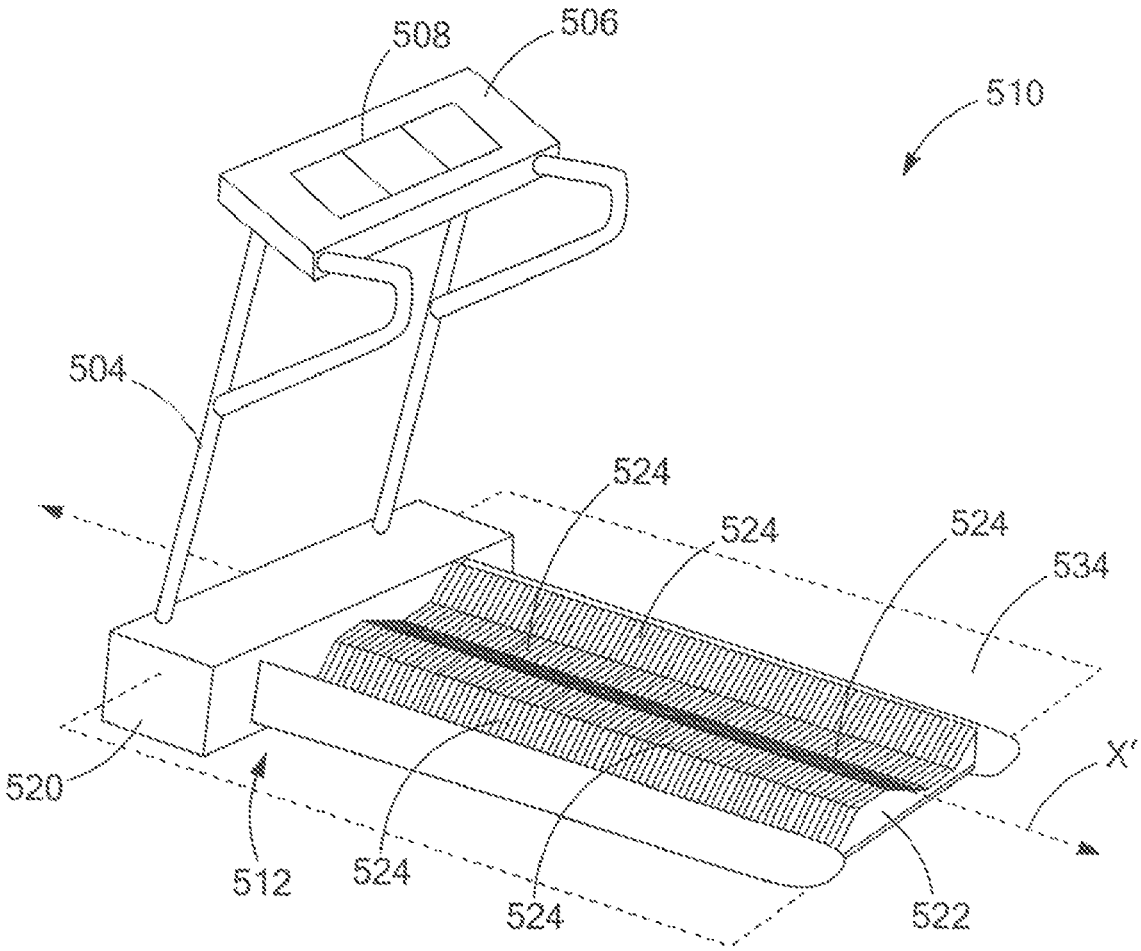
FIG. 9*a* is a perspective view of an exercise device in accordance with even further teachings of the present invention.

According to another example, as illustrated in FIG. 9*a*, there is provided a treadmill, generally indicated at 510. The treadmill includes a support frame 512 defining a horizontal plane 534 (FIG. 9*d*) having a longitudinal axis X'. A handrail 504 extends upwardly from the support frame 512 and a control panel 506 with a user interface 508 is mounted on the handrail 504.

The support frame 512 includes a motorbox 520 in communication with the control panel 506, and an endless running surface 522 upon which a user runs during use of the treadmill and which is adapted to move parallel to a longitudinal axis X'. As can be seen, the endless running surface 522 comprises several longitudinal track portions 524, each of which is angled with respect to the others about an axis parallel to the axis X' (i.e., each track portion 524 lies in a plane which, if rotated about an axis which is parallel to the axis X', would coincide with the planes in which the other track portions lie). In particular, at least one track portion 524 may be angled with respect to the ground, or the horizontal plane 534 defined by the support frame 512, for example, at a degree substantially within the range of about 5° to about 45°. Stated another way, the endless running surface 522 is non-planar and includes at least one pre-formed incline.

The motorbox 520 is in drive communication with the endless running surface 522, and comprises a motor as well as transmission elements (not illustrated) which are well known in the art and which are configured for controlling movement of elements of the base, such as the speed of the endless running surface 522, the pitch of the base or support frame 512, etc., based on commands received from the control panel 506.

Figure 9B:
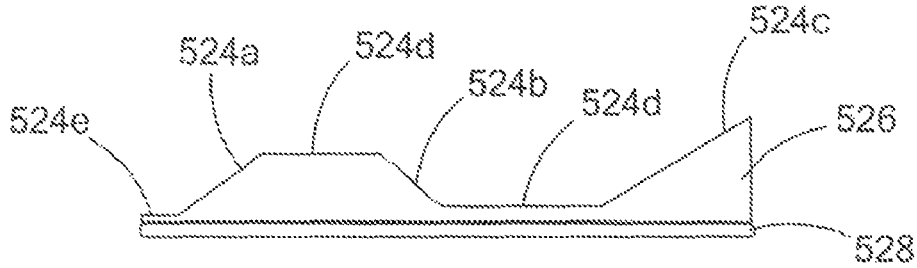
FIGS. 9*b* and 9*c* are front and perspective views, respectively, of a solid section of the running surface of the exercise device illustrated in FIG. 9*a;*

According to one example, as illustrated in FIG. 9*b*, the endless running surface 522 comprises a plurality of solid sections 526 mounted on a belt 528, with the top surfaces of adjacent sections comprising the track portions 524. Thus, stated another way, a number of individual treads or links 526 are linked together along the belt 528 by any suitable means known in the art and the non-planar upper surfaces thereof align to define a running surface 522 with at least one laterally inclined track portion 524, and preferably a plurality of laterally inclined track portions 524.

Figure 9C:
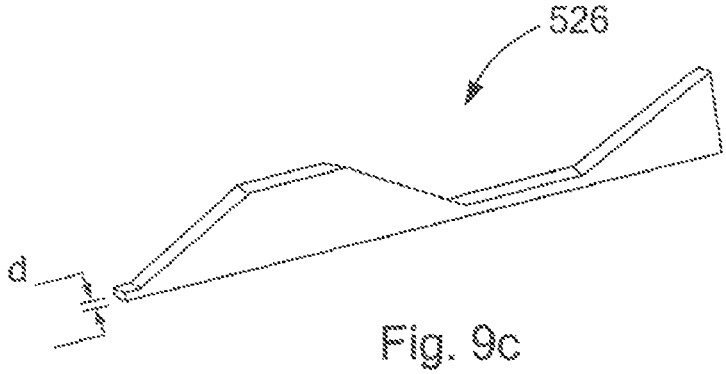
Figure 9D:
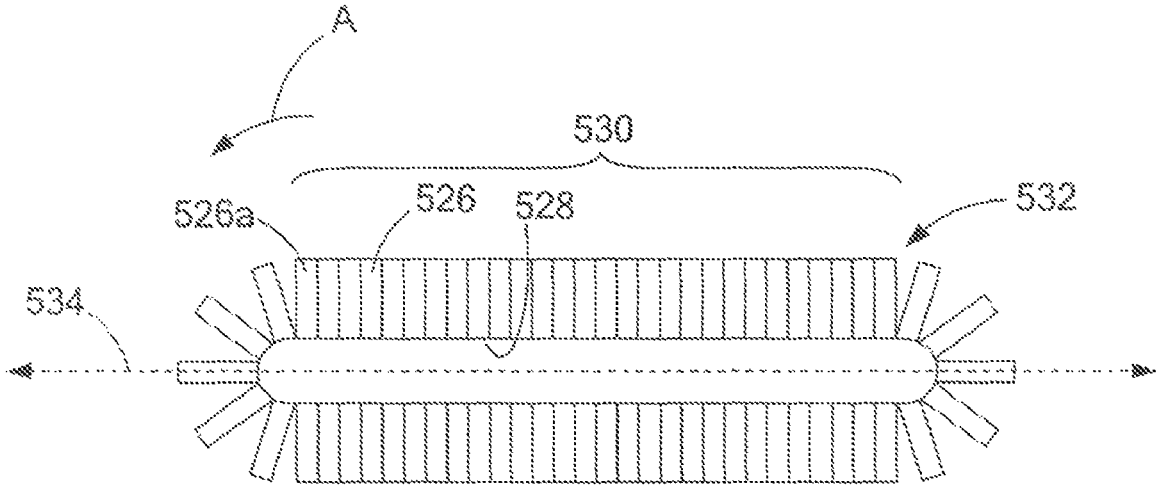
FIG. 9*d* is a side view of the running surface constituted by a plurality of the solid sections illustrated in FIGS. 9*b* and 9*c;*

As seen in FIG. 9*c*, each solid section 526 is relatively narrow along the dimension d which extends in the direction of movement of the endless running surface 522. As illustrated in FIG. 9*d*, this construction allows the upwardly facing sections 526 to abut one another and constitute a temporarily unitary portion 530 of the endless running surface 522, while permitting a leading section 526*a* to quickly separate from the temporarily unitary portion so that it could be returned to the trailing end 532 thereof (the direction of movement of the endless running surface 522 is indicated by arrow A).

Reverting to FIG. 9*b*, it is seen that the endless running surface 522 comprises first and third track portions 524*a*, 524*c* inclined in one sense, e.g., downwardly to the right, and a second track portion 524*b* inclined in an opposite sense, e.g., upwardly to the right. Thus, a user who places his feet and/or runs on the first and second track portions 524*a*, 524*b* will be forced to rotate his ankles such that his feet face outwardly (i.e., with the soles of his feet facing outwardly), and a user who places his feet on the second and third track portions 524*b*, 524*c* will be forced to rotate his ankles such that his feet face inwardly (i.e., with the soles of his feet facing inwardly). This arrangement permits the user to select the type of stress being placed on his ankles, and to easily change it, even in the middle of an exercise session. It will be noticed that an extension 524*e* may be provided projecting from one or both sides of the section 526, e.g., in order to prevent slippage of the user's foot from the endless running surface 522 during use.

Optionally, intermediate track portions 524*d*, which are substantially parallel to the ground or a horizontal plane 534 defined by the support frame 512, may be disposed between adjacent track portions 524*a*, 524*b*, 524*c*. This may be done for spacing of the track portions from one another, or for any other desired reason.

Figure 9E:
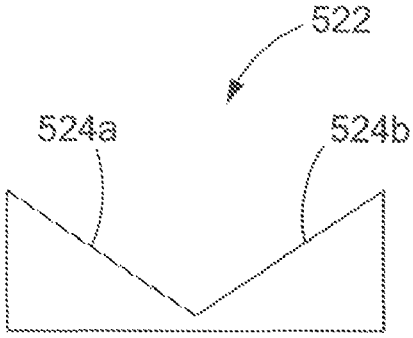
FIGS. 9*e-h* are front views of other examples of solid sections.
Figure 9F:
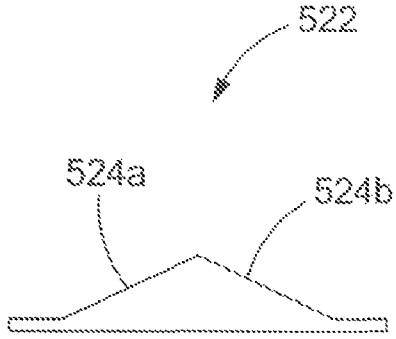
Figure 9G:
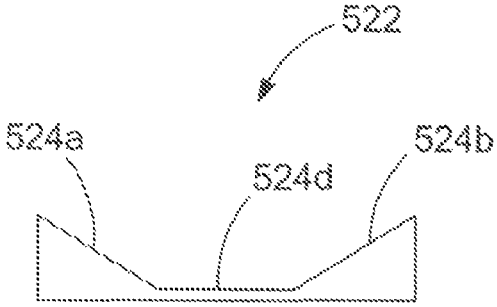
Figure 9H:
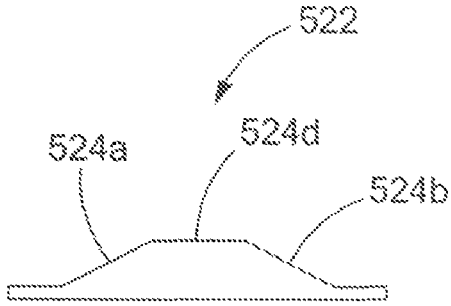

It will be appreciated that other geometries of the top of the endless running surface 522 are possible without deviating from the spirit and scope of the invention. For example, as illustrated in FIGS. 9*e* and 9*f*, the endless running surface 522 may comprise two track portions 524*a*, 524*b* formed as a chevron or as an inverted chevron. These geometries may each be modified, as illustrated in FIGS. 9*g* and 9*h*, with the inclusion of an intermediate track portion 524*d* between the two track portions 524*a*, 524*b*.

Figure 10A:
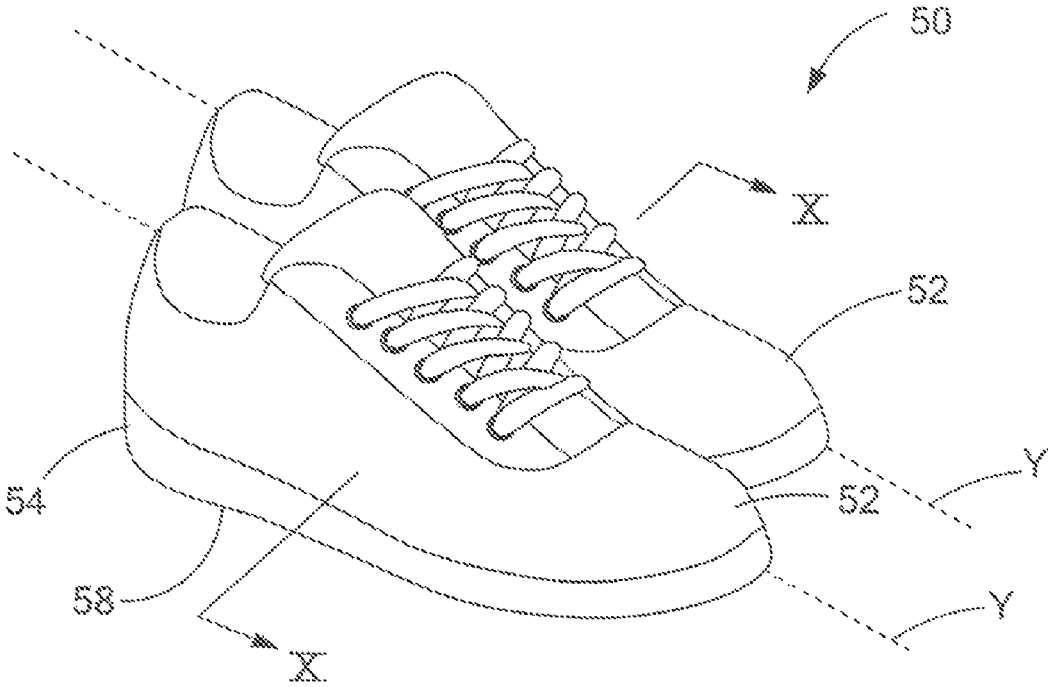
FIG. 10*a* is a perspective view of a pair of shoes according to the present invention.

As illustrated in FIG. 10*a*, there is further provided a pair of training shoes, generally indicated at 50. Each shoe 50 comprises a toe portion 52, a heel portion 54, and a shoe axis Y extending between them. The bottom portion of each shoe is constituted by a sole 56, having an outsole 58 for being in substantially parallel contact with the ground when the wearer is standing, and an insole (not illustrated in FIG. 10*a*). In addition, the shoes 50 comprise other necessary and/or customary shoe components, such as the tongue, laces, vamp, etc. (note specifically indicated).

Figure 10B:
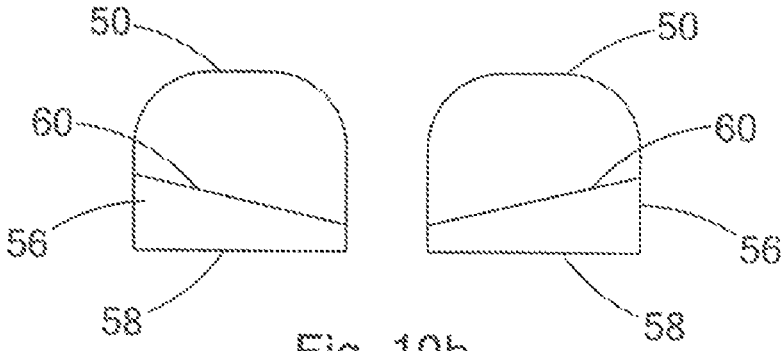
FIGS. 10*b* and 10*c* are cross-sectional views taken along line X-X in FIG. 10*a*, according to two examples.
Figure 10C:
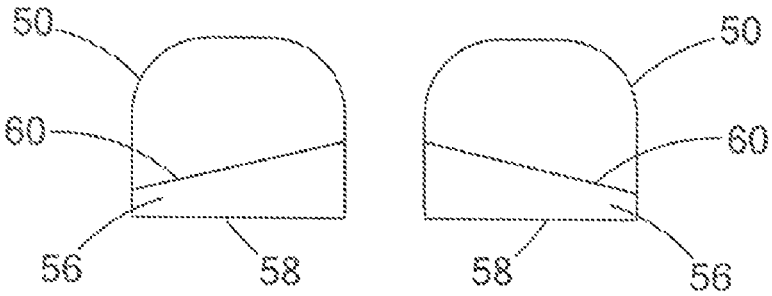

As seen in cross-section in FIGS. 10*b* and 10*c*, the insole 60 of the shoes is angled in relation to the outsole 56 about the axis Y, either inwardly, so that a wearer is forced to rotate his ankles such that his feet face outwardly, or outwardly, so that a wearer is forced to rotate his ankles such that his feet face inwardly.

It will be appreciated that the insoles 60 may be provided integrally and unitarily with the shoes 50, or provided as removable inserts therefor.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. An exercise device comprising:

a support frame defining a horizontal plane having a longitudinal axis; and a running platform supported by the support frame for supporting a user thereon, the running platform including a non-planar running surface longitudinally moveable relative to the support frame, the running surface having at least two portions having a plurality of individual treads that are laterally inclined relative to the horizontal plane of the support frame, the at least two portions including a first inclined portion and a second inclined portion that are laterally inclined in different directions relative to the horizontal plane of the support frame, wherein the first and second inclined portions define flat surfaces having a horizontal width sized to receive a user's foot.

2. The exercise device of claim 1, wherein the at least two portions are laterally inclined at different angles relative to the horizontal plane of the support frame.

3. The exercise device of claim 1, wherein each of the at least two portions is laterally inclined at an angle within the range of between about 5 degrees and about 45 degrees with respect to the horizontal plane of the support frame.

4. The exercise device of claim 1, wherein the at least two portions include a first inclined portion, a second inclined portion, and an intermediate portion disposed in between the first and second inclined portions, the intermediate portion being substantially parallel to the horizontal plane of the support frame.

5. The exercise device of claim 1, wherein the non-planar running surface is comprised of said plurality of individual treads linked together and extending along a movable belt, each individual tread having a correspondingly shaped upper surface, wherein the upper surfaces of the individual treads align to define the at least one laterally inclined portion of the running surface.

6. The exercise device of claim 1, wherein the flat surfaces of the first and second inclined portions extend along the entire longitudinal length on the running surface.

7. The exercise device of claim 6, wherein a plane of the flat surfaces of the first and second inclined portions is maintained along the length of the running surface.

8. An exercise device comprising:

a support frame defining a horizontal plane having a longitudinal axis; and a continuous running surface supported by the support frame for supporting a user thereon, the running surface including a movable belt and a plurality of interconnected sections mounted thereon and extending laterally and serially arranged along a longitudinal axis of the belt, each section including an upper surface having a shape corresponding to each of the other plurality sections, each section shaped to define at least two inclined portions that are laterally inclined relative to the horizontal plane of the support frame, the at least two inclined portions including a first inclined portion and a second inclined portion, wherein adjacent upper surfaces of the plurality of sections define at least two laterally inclined tracks of the running surface.

9. The exercise device of claim 8, wherein the upper surface of each section defines at least two inclined portions including a first inclined portion and a second inclined portion, wherein adjacent upper surfaces of the plurality of sections define at least two laterally inclined tracks of the running surface.

10. The exercise device of claim 8, wherein the first and second inclined portions are immediately adjacent one another.

11. The exercise device of claim 8, wherein the upper surface of each section includes an intermediate portion disposed between the first and second inclined potions, the intermediate portion being substantially parallel to the horizontal plane of the support frame.

12. The exercise device of claim 8, wherein the first and second inclined portions are laterally inclined in different directions.

13. The exercise device of claim 8, wherein the first and second inclined portions are laterally inclined at different angles relative to the horizontal plane of the support frame.

14. The exercise device of claim 8, wherein each of the first and second inclined portions is laterally inclined at an angle within the range of between about 5 degrees and about 45 degrees with respect to the horizontal plane of the support frame.

15. The exercise device of claim 8, wherein the plurality of sections includes adjacent sections in which the upper surfaces thereof abut one another to define a temporarily unitary portion of the continuous running surface, the temporarily unitary portion including a leading end and a trailing end, wherein a leading section of the temporarily unitary portion is configured to separate from the temporarily unitary portion at the leading end and move with the belt toward the trailing end.

16. The exercise device of claim 8, wherein the continuous running surface is configured to move substantially parallel to the longitudinal axis of the support frame.

17. The exercise device of claim 8, wherein each section includes a flat extension portion adjacent the at least one inclined portion to prevent slippage of the user's foot from the running surface.

18. The exercise device of claim 8, wherein the upper surface of each section includes a first inclined portion, a second inclined portion, a third inclined portion, a first flat intermediate portion disposed in between the first and second inclined portions, and a second flat intermediate portion disposed in between the second and third inclined portions.

19. The exercise device of claim 18, wherein the first and third inclined portions are laterally inclined in the same direction relative to the horizontal plane of the support frame, and wherein the first and second flat intermediate portions are parallel to one another and are not coplanar.

20. The exercise device of claim 8, wherein the two laterally inclined tracks extend over the entire length of the continuous running surface.

* * * * *